US006575249B2

(12) United States Patent
Deaton

(10) Patent No.: US 6,575,249 B2
(45) Date of Patent: Jun. 10, 2003

(54) APPARATUS AND METHOD FOR LOCKING OPEN A FLOW CONTROL DEVICE

(76) Inventor: Thomas Michael Deaton, 2222 Maroneal #1615, Houston, TX (US) 77030

( * ) Notice: Subject to any disclaimer, the term of this patent is extended or adjusted under 35 U.S.C. 154(b) by 0 days.

(21) Appl. No.: 09/859,920

(22) Filed: May 17, 2001

(65) Prior Publication Data

US 2002/0170719 A1 Nov. 21, 2002

(51) Int. Cl.[7] ..... E21B 34/12
(52) U.S. Cl. ..... 166/373; 166/332.8
(58) Field of Search ..... 166/373, 332.1, 166/332.4, 332.8; 137/382, 517, 521, 527

(56) References Cited

U.S. PATENT DOCUMENTS

| | | | | |
|---|---|---|---|---|
| 3,696,868 A | | 10/1972 | Taylor, Jr. | |
| 3,786,865 A | | 1/1974 | Tausch et al. | |
| 3,786,866 A | | 1/1974 | Tausch et al. | |
| 4,356,867 A | | 11/1982 | Carmody | |
| 4,411,316 A | | 10/1983 | Carmody | |
| 4,475,599 A | * | 10/1984 | Akkerman | 137/630.14 |
| 4,542,792 A | | 9/1985 | Akkerman | |
| 4,577,694 A | | 3/1986 | Brakhage, Jr. | |
| 4,624,315 A | | 11/1986 | Dickson et al. | |
| 4,660,646 A | | 4/1987 | Blizzard | |
| 4,709,762 A | * | 12/1987 | Pringle | 166/324 |
| 4,723,606 A | | 2/1988 | Vinzant et al. | |
| 4,796,708 A | * | 1/1989 | Lembcke | 166/66.7 |
| 4,967,845 A | | 11/1990 | Shirk | |
| 5,127,476 A | | 7/1992 | Dickson et al. | |

* cited by examiner

*Primary Examiner*—David Bagnell
*Assistant Examiner*—Jennifer R. Dougherty
(74) *Attorney, Agent, or Firm*—Bryan L. White; Jeffrey Griffin; Brigitte Jeffery

(57) ABSTRACT

An apparatus capable of retaining a shiftable valve member in an open position, the shiftable valve member mounted in a valve housing and being moveable between at least one open and at least one closed position relative to a longitudinal bore extending through the valve housing, includes a locking sleeve disposed in the valve housing. The locking sleeve is movable at least partially around the circumference of the bore from at least a first position to at least a second position. When the locking sleeve is disposed in the first position, the locking sleeve allows movement of the shiftable valve member between its open and closed positions. When the locking sleeve is disposed in the second position, the locking sleeve causes the shiftable valve member to be retained in an open position and prevents movement of the shiftable valve member into a closed position. At least one anchor is engageable with the locking sleeve and capable of at least temporarily holding the locking sleeve in at least one of its at least first and second positions.

25 Claims, 4 Drawing Sheets

APPARATUS AND METHOD FOR LOCKING OPEN A FLOW CONTROL DEVICE

BACKGROUND OF THE INVENTION

The invention relates to apparatus and methods for securing a flow control device in an open position. In one embodiment of the invention, a shiftable valve member located in a conduit is securable in an open position.

In fluid flow operations, it is often desirable to secure a flow control device in an open position. Conventional oil and gas well operations, for example, sometimes warrant securing a shiftable valve member in an open position. For a specific example, it may be desirable or necessary to secure, or "lock open", a conventional flapper type safety valve located in a well tubing string in an open position, such as when the valve malfunctions or to allow the performance of well servicing operations through the valve assembly.

Locking devices for flow control devices have been proposed. For example, U.S. Pat. Nos. 3,786,865 and 3,786,866 to Tausch et al., U.S. Pat. Nos. 4,624,315 and 5,127,476 to Dickson et al., U.S. Pat. Nos. 4,411,316 and 4,356,867 to Carmody and U.S. Pat. No. 4,723,606 to Vinzant et al. involve reciprocating or longitudinally movable lockout sleeves for locking flapper valves in an open position.

U.S. Pat. No. 4,577,694 to Brakhage, Jr., U.S. Pat. No. 4,967,845 to Shirk and U.S. Pat. No. 4,542,792 to Akkerman involve valve locking devices that must be run in, or inserted into the well conduit within which the valve assembly is located. U.S. Pat. No. 4,577,694 discloses a locking spring band for permanently locking a flapper valve in an open position. Upon insertion into the conduit and valve assembly, the spring expands peripherally to lock the valve member in an open position. U.S. Pat. No. 4,542,792 uses a locking wedge deliverable with a removable auxiliary device and securable in a ball type safety valve mounted in the conduit for permanently locking the safety valve in the open position. In U.S. Pat. No. 4,967,845, a lock open plug is run into the housing of an axially reciprocating safety valve to secure the plug in an open position.

With respect to each of the above-cited patents, it is important to understand that the features mentioned above are merely examples of features disclosed in the patents. There are numerous other features disclosed in each patent in addition to the features mentioned herein. The additional features can be readily understood from a thorough review of each respective patent. The brief discussion above is included only to introduce the subject matter of the patents and not to distinguish the same from the present invention. Therefore, it is the patent applicant's intent that the brief remarks about the cited patents above not, in any way, limit or affect the scope of any of the appended claims merely because of their mention herein. A comparison of any of the above-cited patents with the invention of any of the appended claims should involve a comparison of all the features of the cited patent together compared with the entirety of the selected claim(s).

In considering existing technology for securing a flow control device in an open position, there remains a need for apparatus and methods having one or more of the following attributes: an apparatus that requires or occupies minimal or no additional length in the flow control device or the conduit within which the flow control device is located; an apparatus contained in, or internal to, the flow control device; an apparatus that is unaffected, or minimally affected, by environmental variables, such as hydrostatic pressure; an apparatus that is cost effective to manufacture, assemble and use, is simple and durable in construction and use and/or includes a minimal quantity of additional parts; an apparatus that is unlikely to be dislodged, or accidentally engaged, due to contact or force from the passage thereby of other devices, or the flow thereby of fluid and/or material.

BRIEF SUMMARY OF THE INVENTION

In accordance with the present invention, certain embodiments involve an apparatus capable of retaining a shiftable valve member in an open position, the shiftable valve member being disposed in a valve housing and moveable between at least one open and at least one closed position relative to a bore in the housing. These embodiments include a locking sleeve and at least one anchor. The locking sleeve is disposed in the valve housing and movable at least partially around the circumference of the bore from at least a first position to at least a second position. When the locking sleeve is disposed in the first position, the locking sleeve allows movement of the shiftable valve member between its open and closed positions. When the locking sleeve is disposed in the second position, the locking sleeve causes the shiftable valve member to be retained in an open position and prevents movement of the shiftable valve member into a closed position. The at least one anchor is engageable with the locking sleeve and capable of at least temporarily holding the locking sleeve in at least one of its first and second positions.

The shiftable valve member may be a flapper valve member disposed in a subsurface well conduit and the locking sleeve may have a semi-circular shape. The locking sleeve may be movable back and forth between its first and second positions. A shifting tool insertable into the bore, engageable with the locking sleeve from within the bore and capable of rotating the locking sleeve between the first and second positions may be included.

The anchor may include at least one resilient urging member and at least one rigid member, the rigid member engageable between the resilient urging member and the locking sleeve to at least temporarily hold the locking sleeve in the second position, or the first and second positions. Further, the locking sleeve may include at least first and second notches, the at least one rigid member may include a ball and the at least one resilient urging member may include a spring, whereby the ball engages the second notch when the locking sleeve is disposed in the first position and the ball engages the first notch when the locking sleeve is disposed in the second position.

At least one anchor may be capable of holding the locking sleeve in the first position and at least one anchor may be capable of holding the locking sleeve in the second position. The at least one anchor may include a ratchet mechanism capable of at least temporarily holding the locking sleeve in its at least first and second positions. The anchor(s) may include a clutch mechanism, whereby the clutch mechanism is capable of at least temporarily holding the locking sleeve in the at least first and second positions. The at least one anchor(s) may include a shear pin releasably engageable with the locking sleeve when the locking sleeve is in the first position. The locking sleeve may be engageable from above the locking sleeve for moving the locking sleeve between the first and second positions.

Certain embodiments of the present invention involve a lock-open device for locking a flapper valve member in an open position, the flapper valve member disposed in a valve housing and being useful in an underground oilfield tubular.

The valve housing has a height and a longitudinally extending bore through its height, and the flapper valve member is hingeably moveable between at least one open and at least one closed position relative to the bore. These embodiments include a locking sleeve having a semi-circular shape and disposed in the valve housing at the same general height as the flapper valve member. The locking sleeve is movable within a circular path at least partially around the circumference of the bore from at least a first position to at least a second position. When the locking sleeve is disposed in the first position, the locking sleeve does not engage the flapper valve member. When the locking sleeve is in the second position, the locking sleeve engages the flapper valve member and retains it in an open position. These embodiments also include at least one anchor engageable with the locking sleeve and capable of at least temporarily holding the locking sleeve in at least one of the at least first and second positions. The locking sleeve may be capable of permanently holding the flapper valve member in an open position. Alternately, the locking sleeve may be capable of temporarily holding the flapper valve member in an open position, whereby the locking sleeve is movable back and forth between different positions.

Various embodiments of the present invention involve a safety valve for use in an oilfield tubular. The safety valve includes a housing having a longitudinal bore extending therethrough, and a flapper valve member disposed in the housing and being hingeably movable relative to the longitudinal bore. The flapper valve member has an open position allowing fluid flow through the longitudinal bore and a closed position disallowing fluid flow through the longitudinal bore. These embodiments also include a rotatable lock-open sleeve disposed in the housing. The rotatable lock-open sleeve is movable in a circular path at least partially around the circumference of the longitudinal bore and adjacent to the flapper valve member, and is capable of holding the flapper valve member in its open position. At least one anchor engageable with the lock-open sleeve and capable of at least temporarily holding the lock-open sleeve in at least one of the first and second positions may be included.

Embodiments of the present invention involve a subsurface safety valve with lock-open capability and useful in an oilfield tubular, and which includes a housing having a longitudinal bore extending therethrough and valve closure means mounted in the housing for allowing and disallowing fluid flow through the longitudinal bore. The valve closure means had an open position, which is capable of allowing fluid flow through the longitudinal bore, and a closed position, which is capable of at least partially blocking fluid flow through the longitudinal bore. A lock-open means for securing the valve closure means in the open position is also included. The lock-open means is permanently disposed in the housing and movable in a generally circular path within the longitudinal bore. These embodiments may also include means for rotating the lock-open means between at least first and second positions, and means for at least temporarily holding the lock-open means in at least one of its first and second positions.

In accordance with the present invention, embodiments of methods of securing a shiftable valve member in an open position with the use of a locking sleeve, the shiftable valve member and locking sleeve being mounted in a housing having a longitudinal bore extending therethrough, the shiftable valve member being moveable between at least one open and at least one closed position relative to the bore and the locking sleeve being rotatable at least partially around the circumference of the bore from at least a first position to at least a second position, the shiftable valve member being retained in an open position when the locking sleeve is in the second position, include moving the locking sleeve in a generally circular path from its first position in the direction of its second position and moving the shiftable valve member into an open position. The method also includes moving the locking sleeve in a generally circular path into its second position and securing the locking sleeve in its second position, thereby securing the valve member in its open position. The method may include inserting a shifting tool into the bore, engaging the shifting tool with the locking sleeve and actuating the shifting tool to rotate the locking sleeve.

The method may include disengaging at least one anchor from the locking sleeve to allow the locking sleeve to be moved out of its first position, and engaging at least one anchor with the locking sleeve in its second position. Yet further, the method may include disengaging at least one anchor from the locking sleeve when the locking sleeve is in its second position and moving the locking sleeve in a generally circular path out of its second position. Even further, the method may include moving the locking sleeve into its first position and engaging at least one anchor with the locking sleeve to hold the locking sleeve in its first position. The shiftable valve member may be a flapper valve member disposed in a subsurface oilfield tubular and the locking sleeve may be a semi-circular member. Of course, the sequence of events described above need not be performed in the precise order listed above.

Accordingly, the present invention includes features and advantages which enable it to substantially advance the technology associated with securing flow control devices in an open position. Characteristics and advantages of the present invention described above, as well as additional features and benefits, will be readily apparent to those skilled in the art upon consideration of the following detailed description of preferred embodiments and referring to the accompanying drawings.

BRIEF DESCRIPTION OF THE DRAWINGS

For a detailed description of the preferred embodiments of the invention, reference will now be made to the accompanying drawings wherein.

DETAILED DESCRIPTION OF PREFERRED EMBODIMENTS

Figure 2B:
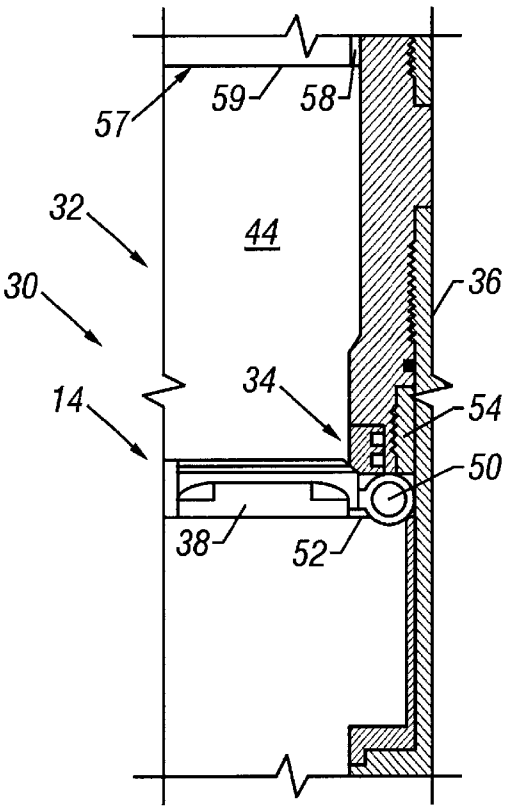
FIG. 2B (Prior Art)
FIG. 2B is a fragmentary elevational view, partly in cross section, showing a typical flapper type safety valve in a closed position.

Presently preferred embodiments of the invention are shown in the above-identified figures and described in detail below. In describing the preferred embodiments, like or identical reference numerals are used to identify common or similar elements. The figures are not necessarily to scale and certain features and certain views of the figures may be shown exaggerated in scale or in schematic in the interest of clarity and conciseness.

The contents of this Detailed Description of Preferred Embodiments, the accompanying "Abstract", "Brief Description of the Drawings", "Brief Summary of the Invention" and "Background of the Invention" sections and appended FIGS. 1–8 are not intended and should not be deemed to limit the scope or construction of any of the appended claims or claim language, except and only to the extent as may be expressly provided in the form of a specific definition contained in this Detailed Description section for particular language that may appear in one or more of the appended claims, such specific definition(s) including the phrase "the term '_____' means". Further, as used herein and throughout the various portions of this specification, the terms "invention", "present invention" and variations thereof are used to generally refer to subject matter that is likely encompassed by one or more of the appended claims, but not as a limitation of any claims. These terms are thus not intended to, and do not, mean the claimed invention of any particular claim(s) or of all of the appended claims. The use herein of the terms "invention", "present invention" and variations thereof should, therefore, not be used to limit the construction or scope of any of the appended claims.

Figure 1:
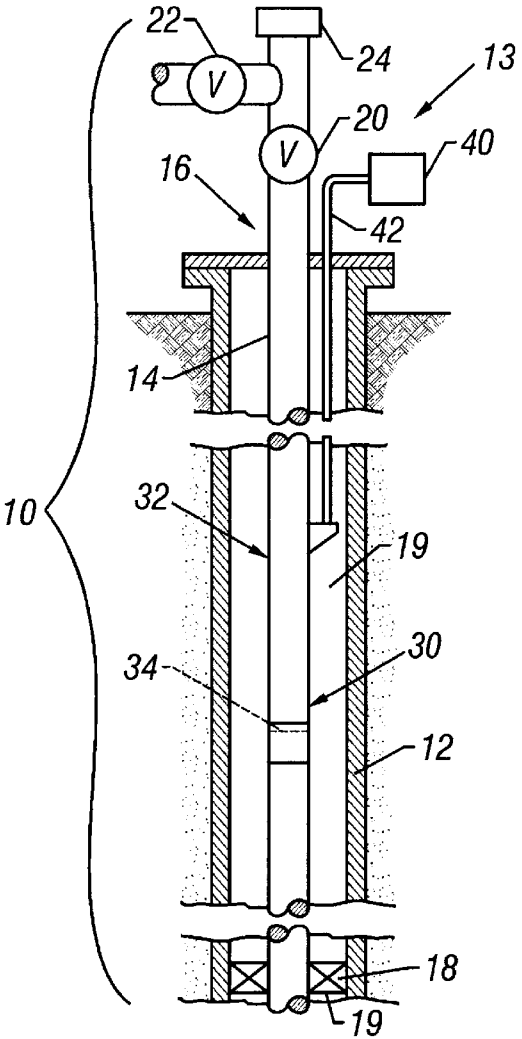
FIG. 1 (Prior Art)
FIG. 1 is a schematic view in section and elevation of a typical well completion including a subsurface safety valve.

Referring to FIG. 1, an exemplary environment within which the present invention may be used is shown as a conventional oil and gas production well or well completion 10, as is known in the art. The illustrated well completion 10 includes a casing string 12 extending from the well surface 13 to a hydrocarbon production formation (not shown). A tubing string 14 is shown concentrically disposed within the casing string 12, and extends from a wellhead 16 through a production packer 18. The production packer 18 of FIG. 1 seals the annulus formed between the tubing and casing strings 14, 12, and directs formation fluids, such as oil, gas and water, into the tubing string 14 that are admitted into the well bore 19 through perforations (not shown) in the casing string 12. Valves 20, 22, which are helpful in controlling fluid flow from the tubing string 14, are shown at the well surface 13. A wellhead cap 24 is useful, for example, to permit servicing the well 10 via tubing string 14 with wireline equipment (not shown).

Still referring to the exemplary environment of FIG. 1, a flow control device 30 is shown installed in the well 10 as a part of the tubing string 14 to assist in controlling fluid flow to the well surface 13 through the tubing string 14 from downhole, as is also known in the art. The illustrated flow control device 30 is a conventional, surface-controlled subsurface safety valve 32 connected in the tubing string 14, such as by suitable threaded connections. The device 30 may be operated, for example, by control fluid conducted from a hydraulic manifold 40 at the well surface through a control line conduit 42. Further explanation of the components, arrangement and operation of a conventional well completion and related equipment can be found in prior art patents and other publications, such as U.S. Pat Nos. 4,723,606, 4,624,315 and 5,127,476, each of which is hereby incorporated by reference herein in its entirety.

The above description and further aspects of a conventional well completion having one or more underground oilfield tubulars and a subsurface safety valve are known in the art and in no way limiting upon the present invention or the appended claims. Moreover, the present invention is not limited to use in the environment of a well completion, oil and gas production well or oilfield tubular, but may be used in any environment where it is desired to be able to retain a valve member of a flow control device having a bore in an open position.

Figure 2A:
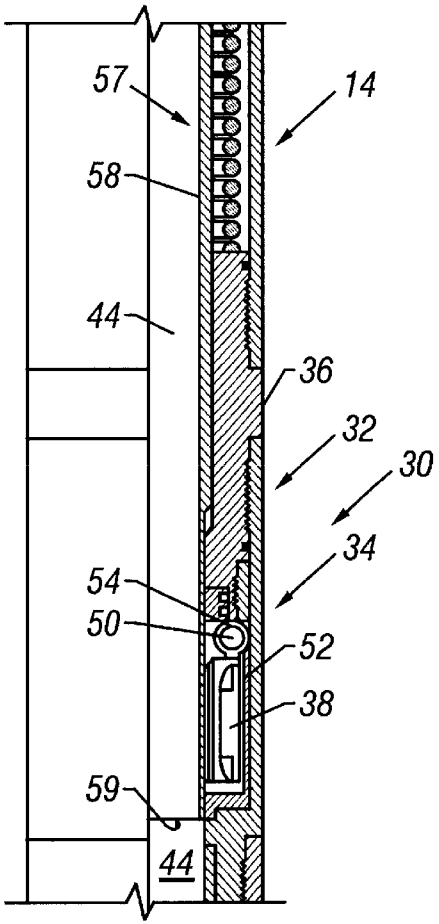
FIG. 2A (Prior Art)
FIG. 2A is a fragmentary elevational view, partly in cross section, showing a typical flapper type safety valve in an open position.

Now referring to FIGS. 2A and 2B, the illustrated safety valve 32 is a conventional flapper type valve assembly 34 generally including a valve housing or body 36 and a flapper member 38. The flapper member 38 is pivotably mounted in the valve housing 36 upon a pin 50 and is movable between at least one open position (FIG. 2A) and at least one closed position (FIG. 2B) relative to a central, longitudinally extending bore 44 through the valve housing 36. A valve opening device 57 is used to open the flapper member 38. In the illustrated valve 32, the valve opening device 57 is a reciprocating tubular member 58 movable downwardly into contact with the flapper member 38 to push it off of a valve seat 54 into an open position, as is known in the art. By maintaining a downward position of the tubular member 58, whereby the tubular member 58 remains engaged with the flapper member 38 and is thus in an "engaged position", the flapper member 38 is (at least temporarily) held in an open position, permitting fluid flow through the bore 44 and well tubing 14, such as during normal operations.

Still referring to FIGS. 2A and 2B, to allow the conventional flapper member 38 to move from an open to a closed position, the tubular member 58 of the exemplary configuration is moved upwardly out of its engaged position. As the lower end 59 of the tubular member 58 moves above the valve seat 54, the spring force of a spring 52 and/or the upward fluid flow through the tubing string 14 and bore 44 moves the flapper member 38 into a closed position. In FIG. 2B, the flapper member 38 is shown yieldably urged about the pin 50 by the spring 52 into a closed position. In this position, the flapper member 38 of FIG. 2 abuts the annular valve seat 54, thus blocking upward flow of fluid through the bore 44 and tubing string 14 (FIG. 1). These and other aspects of the illustrated safety valve are known in art. Further explanation of the components, arrangement and operation of conventional safety valves, such as the flapper type valve assembly 34, and valve opening devices, such as the tubular member 58, are more fully described in prior art patents and publication, such as U.S. Pat. Nos. 3,786,865, 3,786,866, 4,624,315, 5,127,476, 4,411,316, 4,356,867 and 4,723,606, each of which is hereby incorporated by reference herein in its entirety.

The above description and further aspects of safety valves, such as the flapper type valve assembly 34, and valve opening devices, such as the tubular member 58, are in no way limiting upon the present invention or the appended claims. Moreover, the present invention is not limited to use with a flapper type valve, or tubular member type valve opening device, but can be used in connection with any suitable type of flow control device with, or without, any suitable type of valve opening device.

Figure 3:
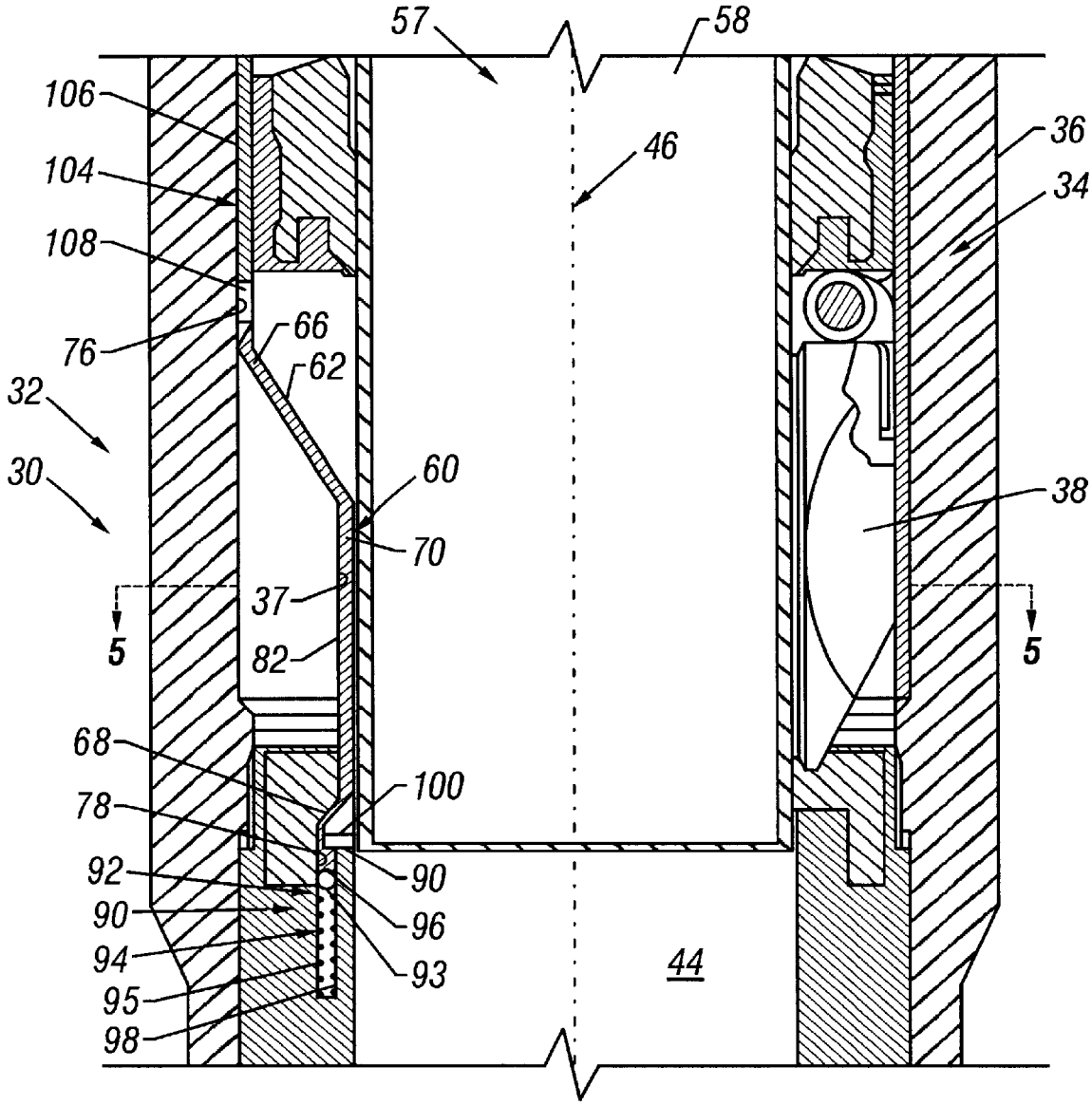
FIG. 3 is a fragmentary elevational view, partly in cross section, of an embodiment of a locking sleeve made in accordance with the present invention shown in connection with a typical flapper type safety valve.
Figure 5:
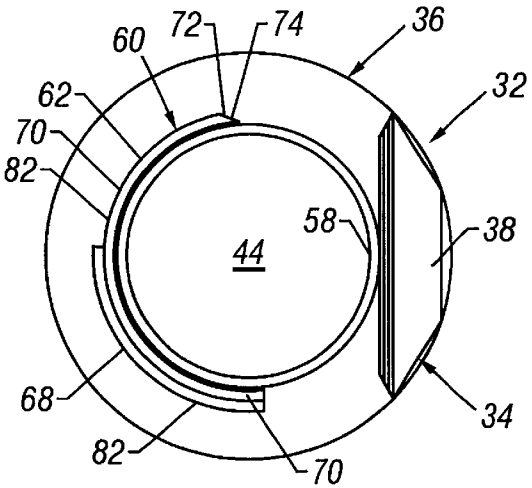
FIG. 5 is a cross-sectional view taken along line 5—5 of FIG. 3 showing the exemplary locking sleeve in an open position.
Figure 4:
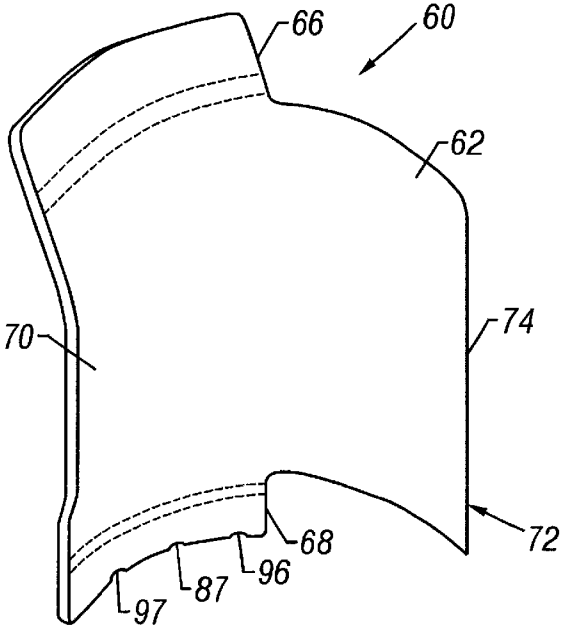
FIG. 4 is an isometric view of the locking sleeve of FIG. 3.

Referring now to FIGS. 3–5, one embodiment of a locking sleeve made in accordance with the present invention is identified with reference numeral "60" and shown in connection with the flapper type valve assembly 34. It should be understood that the exemplary locking sleeve 60 is described herein and shown in the appended drawings in connection with the flapper type valve assembly 34 in a subsurface oilfield tubular for illustrative purposes only.

Figure 7:
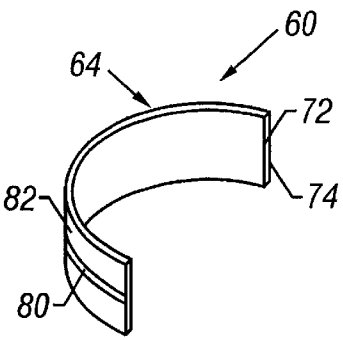
FIG. 7 is an isometric view of another embodiment of a locking sleeve made in accordance with the present invention.

As used throughout this patent specification and in the appended claims, the term "locking sleeve" means a member disposed in a flow control device having a bore and a valve member and which is capable of being moved, or rotated, at least partially around the circumference of the bore to cause the valve member to be retained in an open position. In the embodiment of FIG. 3, the locking sleeve 60 is a semi-circular member that is rotatable at least partially around the circumference of the bore 44 to cause the flapper member 38 to be held, or retained, in an open position. The exemplary locking sleeve 60 is a partial tube-like member 62 disposed in the valve housing 36. It should be understood, however, that the locking sleeve of the present invention need not take such form, but can have any suitable shape and configuration, so long as it is capable of moving at least partially around the circumference of a bore to cause the valve member of a flow control device to be retained in an open position. For another example, the locking sleeve 60 could be a partial ring-like member 64, such as shown in FIG. 7. Although the present invention is often described as using a rotational motion, the movement of the locking sleeve does not preclude longitudinal movement as well.

Referring to FIGS. 3 and 4, the illustrated locking sleeve 60 has upper and lower portions 66, 68 extending from a central portion 70, respectively. The exemplary upper and lower portions 66, 68 are generally tube-shaped and slidably movable within annular cavities 76, 78 formed in the valve housing 36, respectively, thus assisting in maintaining the locking sleeve 60 in its axial, or longitudinal, position in the housing 36. However, the upper and lower portions 66, 68 can take any suitable shape and configuration. For example, the portions 66, 68 could each have an arm-like shape (not shown). Further, the locking sleeve of the present invention need not include upper and lower portions, such as portions 66, 68. Any suitable configuration or mechanism(s) capable of assisting in maintaining the locking sleeve 60 in an axial position can be used. For example, only an upper or lower portion, such as portion 66 or 68, may be included. For another example, a protruding portion, such as a ridge 80 as shown in FIG. 7, extending partially or entirely around the outer surface 82 of the locking sleeve 60 and engageable with a corresponding slot (not shown), or other matable member, disposed in the valve housing 36, or other component, may be included. For yet another example, such configuration could be reversed, whereby a protrusion (not shown) disposed in the valve housing 36 or other member is engageable with a slot (not shown) formed in the outer surface 82 of the locking sleeve 60.

Still referring to FIGS. 3 and 4, the exemplary central portion 70 of the locking sleeve 60 includes a leading edge 72 (FIG. 4) having an engagement surface 74 designed to contact the flapper member 38. The engagement surface 74 can be constructed of any suitable material that is preferably capable of maintaining effective contact with the flapper valve member 38 and withstanding such contact without substantial wear to itself or the member 38 for an acceptable period of use as is or becomes known in the art. The exemplary central portion 70 is disposed in a recess 37 in the valve housing 36 and is movable, or rotatable, around the bore 44 of the housing 36. The sleeve 60 may, if desired, be designed so that the central portion 70 is also movable around the valve opening device 57, such as the tubular member 58 when the tubular member 58 is in an engaged position (See, e.g. FIG. 3).

Figure 6:
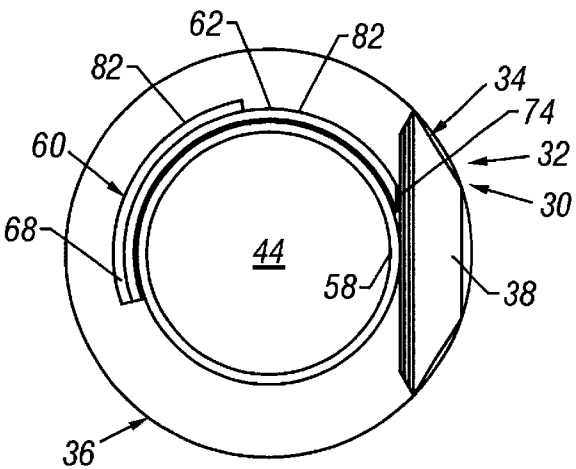
FIG. 6 is a view similar to FIG. 5 but showing the exemplary locking sleeve in a closed position and engaged with the flapper member of the typical flapper type safety valve.

Referring to FIG. 3, the exemplary locking sleeve 60 is rotatable or movable around the bore 44 from at least a first position, such as shown in FIG. 5, to at least a second position, such as shown in FIG. 6, relative to the flapper member 38, as will be described further below. The locking sleeve 60 is held in its first and second positions (and other positions, if desired) with the use of one or more anchors 90. As used throughout this patent specification and the appended claims, the term "anchor" means a device capable of at least temporarily retaining a locking sleeve made in accordance with the present invention in at least a first disengaged or second engaged position.

The anchor(s) 90 may take any suitable construction, form, configuration and location, so long as the locking sleeve can be releasably held in a first disengaged position and either releasably or non-releasably held in a second engaged position. The anchor(s) 90 can thus be designed for permanent lock-open of the safety valve 32, or for multiple uses whereby the locking sleeve 60 is movable back and forth between engaged and disengaged positions. Further, if desired, the anchor(s) 90 can be designed to hold the locking sleeve 60 in additional positions between or beyond a first (disengaged) and a second (engaged) positions.

In the embodiment of FIG. 3, for example, a first anchor 90 includes a rigid member 92 that is biased, when the locking sleeve 60 is in its first position, by a resilient urging member 94 into engagement with a first notch 96 formed in the locking sleeve 60. The exemplary rigid member 92 is similarly biased into engagement with a second notch 97 in the locking sleeve 60 when the sleeve 60 is in its second position. The rigid member 92 may engage yet additional notches (not shown) formed in the locking sleeve 60 when the sleeve 60 is in one or more other positions, if desired.

Figure 4B:
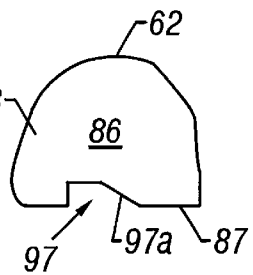
FIG. 4B is an exploded view of a second anchor notch of the exemplary locking sleeve shown in FIG. 4.

Referring to FIGS. 3 and 4, the exemplary rigid member 92 is a ball 93, while the exemplary resilient urging member 94 is a spring 95, both of which can take any suitable configuration and construction, such as commercially available ball and spring members. The illustrated ball 93 and spring 95 are shown disposed in a cavity 98 in the valve housing 36, while the first and second notches 96, 97 are shown formed in the lower portion 68 of the locking sleeve 60. In the embodiment of FIG. 4, the notch 96 is designed with a sloping wall 96*a* (FIG. 4A), while the notch 97 is designed with sloping wall 97*a* (FIG. 4B), allowing movement of the locking sleeve 60 back and forth between first and second positions, such as shown in FIGS. 5 and 6. Alternately, the notch 97 may be formed with non-sloping walls (not shown), so that once the rigid member 92 engages the notch 97, the locking sleeve 60 remains in the engaged position, providing permanent lock-open of the valve member.

It should be understood, however, that the rigid member 92 and resilient urging member 94 need not take the form of a ball 93 and spring 95, but may take any suitable form as is or becomes known in the art, such as, for example, a detent (not shown). Further, the members 92, 94 need not be disposed in the cavity 98, and the notches 96, 97 need not be formed in the lower portion 68 of the locking sleeve 60. These components may instead be disposed or formed in any suitable location. Yet further, the rigid member 92 need not engage notches 96, 97, but may be engageable with any suitable portion of, or component associated with, the locking sleeve 60. Moreover, the anchor(s) 90 may take an entirely different form that does not include members 92, 94 or notches 96, 97, or the like.

Still referring to FIG. 3, a second anchor 90 is shown including a shear pin 100 engaged with locking sleeve 60 when the locking sleeve 60 is initially in a non-engaged position. The shear pin 100 may be included in any suitable location and may engage any suitable part of the locking sleeve 60. For example, the shear pin 100 of FIG. 3 is disposed in the valve housing 36 and engages the lower portion 68 of the locking sleeve 60. The shear pin 100 is designed with strength tolerances to retain the locking sleeve 60 in a first disengaged position during normal operations. When certain rotational force(s), or torque, is/are applied to the sleeve 60, the pin 100 will break and not further inhibit movement of the sleeve 60.

The shear pin 100 of the illustrated embodiment is thus used in addition to the members 92, 94 to assist in ensuring the locking sleeve 60 remains in a disengaged position until movement therefrom is desired. However, any suitable configuration of one or more anchors 90, with or without one or more shear pins 100 may be used. Yet additional embodiments and configurations of anchors 90 suitable for use alone or in combination with other anchors will be apparent to those skilled in the art, such as, for example, the use of clutch (not shown) or a ratchet (not shown) mechanisms.

The locking sleeve 60 may be rotatable or movable around the bore 44 (and about the longitudinal axis 46 of the bore 44) with any suitable control mechanism and/or technique. To effect such movement, the locking sleeve 60 may be engaged from above, from inside the bore 44 or in any other suitable manner. In the embodiment of FIG. 3, for example, the locking sleeve 60 is engageable from above by a surface controllable rotation tool 104 disposed in, or insertable into, the cavity 76. In this configuration, the rotation tool 104 is a partial-tube like member 106 having a series of rigid fingers, or claws, 108 engageable with one or more holes (not shown) in the locking sleeve 60. The member 106 is hydraulically actuated from the surface to enable engagement of the fingers 108 with the holes (not shown) and to apply torque for rotating the locking sleeve 60. However, if a rotation tool 104 is used, it may take any other suitable form, may engage the sleeve 60 in any suitable manner and may be controlled with any suitable control, or actuation, mechanism/technique.

Figure 8:
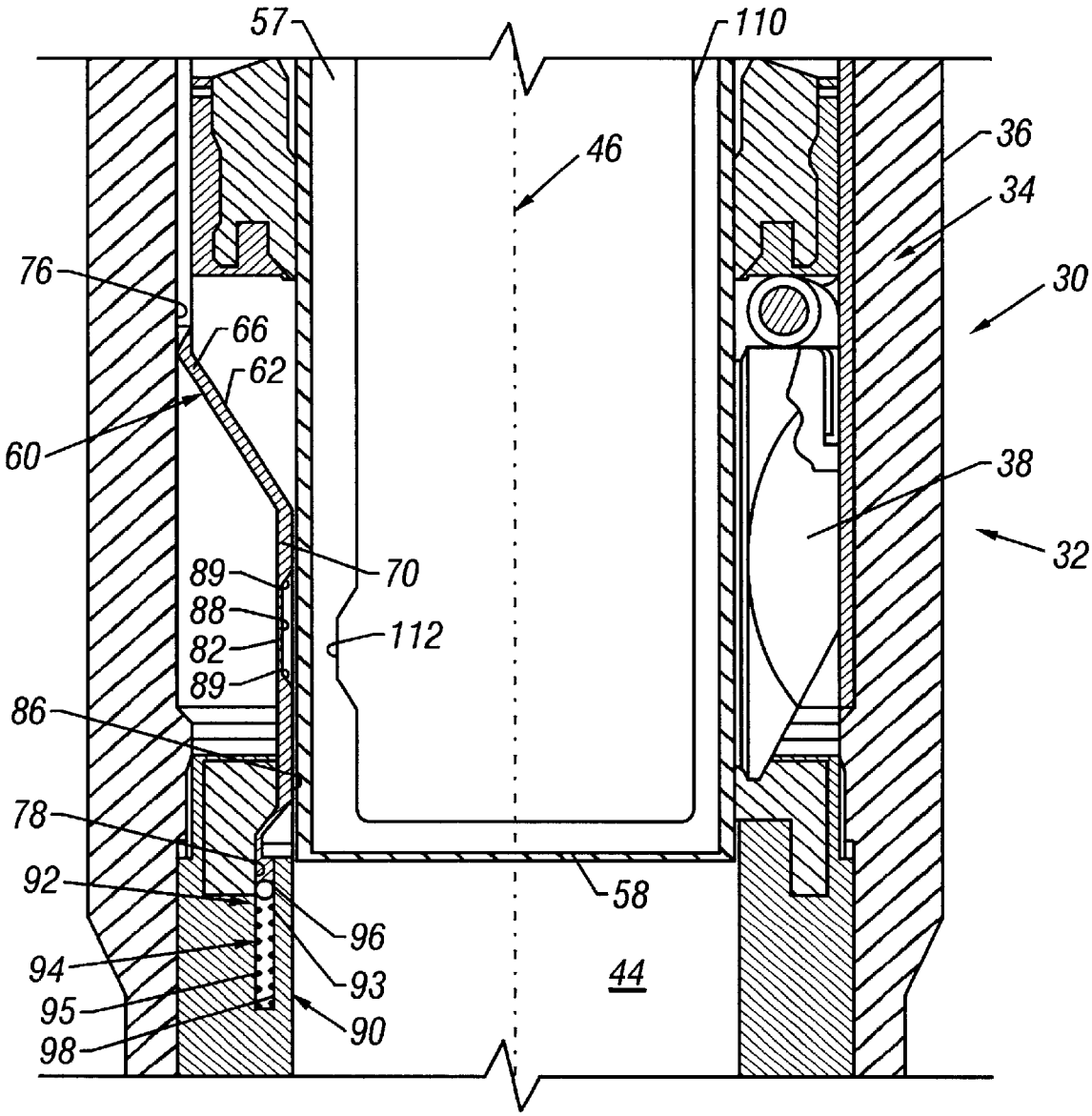
FIG. 8 is a fragmentary elevational view, partly in cross section, of yet another embodiment of a locking sleeve made in accordance with the present invention shown in connection with an exemplary shifting tool and a typical flapper type safety valve.

For another example, referring now to the embodiment of FIG. 8, a shifting tool 110 is used to rotate the locking sleeve 60 from inside the bore 44. The illustrated shifting tool 110 has one or more protruding portions 112 matable, or engageable, with one or more indents or recesses 88 formed into the interior surface 86 of the locking sleeve 60. The exemplary recess 88 may, if desired, be formed with beveled edges 89 to avoid undesirably catching on, or grabbing, other items moving or being moved through the bore 44 during operations, such as well tools (not shown) that may be used in the exemplary environment. However, the shifting tool 110 may take any other suitable configuration, so long as it is capable of moving the locking sleeve 60 around the bore 44 at least from a disengaged to an engaged position. Examples and further descriptions of shifting tools that can be used, or modified by persons of ordinary skilled in the art to be used, with the present invention can be found in U.S. Pat. Nos. 4,723,606 and 3,786,865. Moreover, it should be understood that a shifting tool is not necessary for the present invention. The shifting tool 110 and its construction and operation are thus not intended to, and should not, limit the present invention or any of the appended claims, unless and only to the extent as may be expressly provided for in a particular claim or claims.

Exemplary methods or operations of preferred embodiments of the present invention will now be described. Referring initially to FIGS. 3 and 5, the locking sleeve 60 is preferably pre-in a first, or disengaged, position. However, such pre-setting is not essential for the present invention. In any case, the locking sleeve 60 can be temporarily held in a disengaged position by one or more anchor(s) 90. For example, in the embodiment of FIG. 3, the ball 93 engages the first notch 96 of the locking sleeve 60, and the shear pin 100 engages the sleeve 60. In its first or disengaged position, the locking sleeve 60 does not engage the valve member, such as the flapper member 38, thereby allowing the valve member to move, or be moved, between open and closed positions as desired. This position typically represents the normal status of the locking sleeve 60 during operation of the system within which the safety valve 32 is a part.

Referring to FIG. 3, when it is desirable to utilize the locking sleeve 60, the sleeve 60 is moved or rotated around the bore 44 to a second or engaged position, such as shown in FIG. 6. As the sleeve 60 is initially moved from its first (or other disengaged) position, one or more anchor(s) 90 are disengaged, generally allowing the locking sleeve 60 to move out of a disengaged position and around the bore 44. With the use of the particular embodiment of FIG. 3, the application of torque in a clockwise direction to the locking sleeve 60 causes the shear pin 100 to break and the ball 93 to move down the sloping wall 96*a* (FIG. 4A) of the first notch 96 (FIG. 4). As the locking sleeve 60 is further rotated, the ball 93 exits the notch 96 and moves along the lower surface, or edge, 87 (FIG. 4) of the sleeve 60. The upper and lower portions 66, 68 of the locking sleeve 60 move within cavities 76, 78, respectively, while the central portion 70 moves about the longitudinal axis 46 of the bore 44.

After approximately ninety (90) degrees of clockwise rotation, the exemplary locking sleeve 60 reaches its second, or engaged, position. In the engaged position, the locking sleeve 60 engages or abuts the valve member, such as flapper member 38, restraining and securing it in an open position. In the embodiment of FIGS. 3, 4 and 6, for example, the engagement surface 74 of the leading edge 72 of the locking sleeve 60 contacts the flapper member 38. However, the ninety (90) degrees of rotation, use of the first and second positions shown in FIGS. 5 and 6 and engagement of the leading edge 72 of the sleeve 60 with the valve member 38 are not required for the present invention. For example, the locking sleeve 60 could be rotated more or less than ninety (90) degrees between engaged and disengaged positions. For another example, the engaged position of the locking sleeve 60 could be farther around the bore 44 with respect to the flapper member 38 (or other valve member), such as where the outer surface 82 (FIG. 6) of the sleeve 60 engages or abuts the member 38. For still a further example, the locking sleeve 60 could be designed for rotation between more than two positions.

Any suitable technique and/or mechanism may be used to move or rotate the locking sleeve 60. In the embodiment of FIG. 8, for example, the shifting tool 110 is inserted into the bore 44 by conventional wireline or pump-down operations (not shown). The shifting tool 110 may be designed to move the valve member of the safety valve 32 into an open position, if desired. With the use of the embodiment of FIG. 8, for example, if the flapper member 38 is not in a fully open position (not shown), the shifting tool 110 will contact the flapper member 38 as it is lowered into the bore 44 and will push the member 38 into an open position. The shifting tool 110 may also, or instead, be designed to be insertable into the bore 44 while a valve opening device 57 is engaged with the valve member. For example, referring to the embodiment of FIG. 8, after the shifting tool 100 is inserted into the bore 44 in the generally proximity of the valve member 38, the tubular member 58 is removed, allowing the shifting tool 110 thereafter to engage and rotate the locking sleeve 60.

Still with reference to the use of a shifting tool 110, the shifting tool 110 is engageable with the locking sleeve 60 in any suitable manner. For example, the protruding portion(s) 112 of the tool 110 of FIG. 8 are moved into engagement with the recess(es) 88 formed on the sleeve 60. In another configuration, the shifting tool 100 may be expandable or inflatable to be able to both fit into the bore 44 when the valve opening device 57 is engaged with the valve member and engage the locking sleeve 60 for rotating the sleeve 60 around the bore 44. Any suitable expansion or inflation mechanism that is or becomes know in the art may be used, if such feature is desired.

The shifting tool 110 is thereafter moved, or rotated, applying torque to the locking sleeve 60 and turning the sleeve 60 in the desired direction. Torque is applied to the locking sleeve 60 by the shifting tool 110 in any suitable manner, such as with the use of a housing subassembly (not shown) or fishing tool (not shown), standard well servicing techniques and/or surface wireline equipment (not shown). For example, the shifting tool 110 of FIG. 8 may be connected to a wireline tool string (not shown) and movable by rotating, or torquing the wireline tool string.

When the locking sleeve 60 has been repositioned as desired, such as in the engaged position, it is retained in its engaged position by one or more anchors 90. In the embodiment of FIGS. 3 and 4, for example, the ball 93 becomes seated in, or engages, the second notch 97 formed in the sleeve 60, thus securing the sleeve 60 in the engaged position and the flapper member 38 in an open position.

Figure 4A:
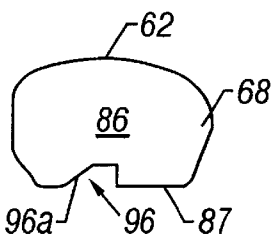
FIG. 4A is an exploded view of a first anchor notch in the exemplary locking sleeve shown in FIG. 4.

If desired, such as with the use of the embodiments of FIGS. 3 and/or 8, the sleeve 60 may be movable back from an engaged to a disengaged position. For example, the shifting tool 110 (FIG. 8) may be reinserted into the bore 44 and the protruding portion(s) 112 reengaged with the recess (es) 88 on the sleeve 60. The tool 110 is thereafter moved as necessary to move sleeve 60 as desired. Rotation of the exemplary locking sleeve 60 from its engaged position in a counterclockwise direction will cause the ball 93 to move down the sloping wall 97*a* (FIG. 4B) of the second notch 97 (FIG. 4) and out of the notch 97. As the exemplary locking sleeve 60 reaches its first, or a desired disengaged, position, the ball 93 reenters the notch 96 via the sloping wall 96*a* (FIGS. 4, 4A). Alternately, the sleeve 60 may be designed for similar movement into or between additional positions, or may be movable only once from a disengaged to an engaged position.

It should be understood that exemplary methods of the present invention need not include all of the operations described above, and such operations need not be performed in any particular order, such as the order above. Further, the methods of the present invention do not require use with the particular embodiments of items shown and described in the present specification, such as, for example, the exemplary locking sleeves and anchors, but are equally applicable with any other suitable structure, form and configuration of components. In addition, in every case, caution must be used in manufacturing, assembling, handling and operating any apparatus made or used in accordance with the present invention.

Preferred embodiments of the present invention are thus well adapted to carry out one or more of the objects of the invention. Further, the apparatus and methods of the present invention offer advantages over the prior art that have not been specifically addressed herein but are, or will become, apparent from the description herein, the appended drawings and claims. In addition, it should also be understood that certain features and subcombinations of the present invention are of utility and may be employed without reference to other features and subcombinations. This is contemplated and within the scope of the appended claims.

While preferred embodiments of this invention have been shown and described, many variations, modifications and/or changes of the apparatus and methods of the present invention, such as in the components, details of construction and operation, arrangement of parts and/or methods of use, are possible, contemplated by the applicant, within the scope of the appended claims, and may be made and used by one of ordinary skill in the art without departing from the spirit or teachings of the invention and scope of appended claims. Because many possible embodiments may be made of the present invention without departing from the scope thereof, it is to be understood that all matter herein set forth or shown in the accompanying drawings is to be interpreted as illustrative and not limiting. Accordingly, the scope of the invention and the appended claims is not limited to the embodiments described and shown herein.

What is claimed is:

1. An apparatus capable of retaining a shiftable valve member in an open position, the shiftable valve member mounted in a valve housing, the valve housing having a bore, the shiftable valve member being moveable between at least one open and at least one closed position relative to the bore, the apparatus comprising:

a locking sleeve disposed in the valve housing and being movable at least partially around the circumference of the bore from at least a first position to at least a second position, whereby when said locking sleeve is disposed in said first position, said locking sleeve allows movement of the shiftable valve member between its open and closed positions, and when said locking sleeve is disposed in said second position, said locking sleeve causes the shiftable valve member to be retained in an open position and prevents movement of the shiftable valve member into a closed position; and at least one anchor engageable with said locking sleeve and capable of at least temporarily holding said locking sleeve in at least one of said at least first and second positions.

2. The apparatus of claim 1 further including a shifting tool insertable into the bore, said shifting tool being engageable with said locking sleeve from within the bore and capable of rotating said locking sleeve between said first and second positions.

3. The apparatus of claim 1 wherein the shiftable valve member is a flapper valve member disposed in a subsurface well conduit and the locking sleeve has a semi-circular shape.

4. The apparatus of claim 3 wherein at least one of said at least one anchor is capable of holding said locking sleeve in said first position and at least one of said at least one anchor is capable of holding said locking sleeve in said second position.

5. The apparatus of claim 4 wherein said anchor includes a ratchet mechanism, whereby said ratchet mechanism is capable of at least temporarily holding said locking sleeve in said at least first and second positions.

6. The apparatus of claim 4 wherein said anchor includes a clutch mechanism, whereby said clutch mechanism is capable of at least temporarily holding said locking sleeve in said at least first and second positions.

7. The apparatus of claim 4 wherein said at least one anchor includes a shear pin releasably engageable with said locking sleeve when said locking sleeve is in said first position.

8. The apparatus of claim 7 wherein said locking sleeve is engageable from above said locking sleeve for moving said locking sleeve between said first and second positions.

9. The apparatus of claim 1 wherein said locking sleeve is movable back and forth between said first and second positions.

10. The apparatus of claim 9 wherein said anchor includes at least one resilient urging member and at least one rigid member, said rigid member engageable between said resilient urging member and said locking sleeve to at least temporarily hold said locking sleeve in said second position.

11. The apparatus of claim 10 wherein said rigid member is capable of at least temporarily holding said locking sleeve in said first and second positions.

12. The apparatus of claim 11 wherein said locking sleeve includes at least first and second notches, said at least one rigid member includes a ball and said at least one resilient urging member includes a spring, whereby said ball engages said second notch when said locking sleeve is disposed in said first position and said ball engages said first notch when said locking sleeve is disposed in said second position.

13. A lock-open device for locking a flapper valve member in an open position, the flapper valve member disposed in a valve housing and being useful in an underground oilfield tubular, the valve housing having a height and a longitudinally extending bore through its height, the flapper valve member being hingeably moveable between at least one open and at least one closed position relative to the bore, the apparatus comprising:

a locking sleeve having a semi-circular shape and being slidably mounted in the valve housing at the same general height as the flapper valve member, said locking sleeve being movable within a generally circular path at least partially around the circumference of the bore from at least a first position to at least a second position, wherein when said locking sleeve is disposed in said first position, said locking sleeve does not engage the flapper valve member, and when said locking sleeve is in said second position, said locking sleeve engages the flapper valve member and retains the flapper valve member in an open position; and at least one anchor engageable with said locking sleeve and capable of at least temporarily holding said locking sleeve in at least one of said at least first and second positions.

14. The lock-open device of claim 13 whereby said locking sleeve is capable of permanently holding the flapper valve member in an open position.

15. The lock-open device of claim 13 whereby said locking sleeve is capable of temporarily holding the flapper valve member in an open position, whereby said locking sleeve is movable back and forth between different positions.

16. A safety valve for use in an oilfield tubular, the safety valve comprising:

a housing having a longitudinal bore extending therethrough;

a flapper valve member mounted in said housing and being hingeably movable relative to said longitudinal bore, said flapper valve member having an open position allowing fluid flow through said longitudinal bore and a closed position disallowing fluid flow through said longitudinal bore; and a rotatable lock-open sleeve disposed in said housing, said rotatable lock-open sleeve being actuated by being moved in a generally circular path at least partially around the circumference of said longitudinal bore and adjacent to said flapper valve member, said rotatable lock-open sleeve being capable of holding said flapper valve member in its open position.

17. The safety valve of claim 16 wherein said lock-open sleeve is movable from a first disengaged position to a second engaged position, further comprising at least one anchor engageable with said lock-open sleeve and capable of at least temporarily holding said lock-open sleeve in at least one of said first and second positions.

18. A subsurface safety valve with lock-open capability and useful in an oilfield tubular, the subsurface safety valve comprising:

a housing having a longitudinal bore extending therethrough;

valve closure means mounted in said housing for allowing and disallowing fluid flow through said longitudinal bore, said valve closure means having an open position capable of allowing fluid flow through the longitudinal bore and a closed position capable of at least partially blocking fluid flow through the longitudinal bore; and lock-open means for securing said valve closure means in said open position, said lock-open means being permanently disposed in said housing and actuated by being moved in a generally circular path within said longitudinal bore.

19. The subsurface safety valve of claim 18 further comprising means for rotating said lock-open means between at least first and second positions and means for at least temporarily holding said lock-open means in at least one of said first and second positions.

20. A method of securing a shiftable valve member in an open position with the use of a locking sleeve, the shiftable valve member and locking sleeve being mounted in a housing having a longitudinal bore extending therethrough, the shiftable valve member being moveable between at least one open and at least one closed position relative to the bore, the locking sleeve being rotatable at least partially around the circumference of the bore from at least a first position to at least a second position, the shiftable valve member being retained in an open position when the locking sleeve is in the second position, the method comprising:

moving the locking sleeve in a generally circular path from its first position in the direction of its second position;

moving the shiftable valve member into an open position;

moving the locking sleeve in a generally circular path into its second position; and securing the locking sleeve in its second position, thereby securing the valve member in its open position.

21. The method of claim 20 further including disengaging at least one anchor from the locking sleeve to allow the locking sleeve to be moved out of its first position, and engaging at least one anchor with the locking sleeve in its second position.

22. The method of claim 21 further including disengaging at least one anchor from the locking sleeve when the locking sleeve is in its second position and moving the locking sleeve in a generally circular path out of its second position.

23. The method of claim 22 further including moving the locking sleeve into its first position and engaging at least one anchor with the locking sleeve to hold the locking sleeve in its first position.

24. The method of claim 23 wherein the shiftable valve member is a flapper valve member disposed in a subsurface oilfield tubular and the locking sleeve is a semi-circular member.

25. The method of claim 23 further including inserting a shifting tool into the bore, engaging the shifting tool with the locking sleeve and actuating the shifting tool to rotate the locking sleeve.

* * * * *